US006163893A

United States Patent [19]

Lo

[11] Patent Number: 6,163,893

[45] Date of Patent: Dec. 26, 2000

[54] DEODORIZING TOILET SEAT PAD

[76] Inventor: Larry Lo, No. 31, Lane 125, Ser-Jeh Street, Taipei City, Taiwan

[21] Appl. No.: 09/292,322

[22] Filed: Apr. 15, 1999

[51] Int. Cl.[7] ..... E03D 9/04

[52] U.S. Cl. ..... 4/217

[58] Field of Search ..... 4/213, 217

[56] References Cited

U.S. PATENT DOCUMENTS

| | | | |
|---|---|---|---|
| 988,273 | 3/1911 | Levenhagen et al. | 4/217 |
| 3,230,551 | 1/1966 | Kopp | 4/213 |
| 3,599,253 | 8/1971 | Maisch | 4/217 X |
| 5,292,479 | 3/1994 | Haraga et al. | 4/217 X |

*Primary Examiner*—Charles E. Phillips
*Attorney, Agent, or Firm*—Raymond Y. Chan; David and Raymond

[57] ABSTRACT

A deodorizing toilet seat pad comprises essentially an ozone-generating means, a toilet seat pad, a base plate, a fan, and an active carbon container. Wherein, said ozone-generating means is provided on the rear end of said toilet seat, while said toilet seat pad is engaged pivotally on said ozone-generating means and is assembled tightly with said base plate such that a hollow channel is formed between said base plate. One or more air scoops are provided at the inner peripheries of said toilet seat pad and said base plate. Said fan is mounted at the air outlet on said ozone-generating means. Said active carbon container is provided on the outside of said fan. When practicing, under operation of said fan, odor generated in said toilet seat can be drawn through said air scoops and said hollow channel into said ozone-generating means where odor is subjected to deodorizing and then, the odor treated is drawn further to pass through said fan and said active carbon to remove residual stench such that gas discharged can be deodorized thoroughly to assure the cleanness of the environment.

1 Claim, 3 Drawing Sheets

DEODORIZING TOILET SEAT PAD

BACKGROUND OF THE PRESENT INVENTION

1. Field of the Present Invention

The invention relates to a deodorizing seat pad for toilet bowls) and in particular, to an improved structure of seat pad which can be provided conveniently on a toilet bowl, securely withdrawing odor generated in the toilet bowl and discharging fresh air to the ambient atmosphere after a deodorizing treatment so as to maintain environmental hygiene.

2. Description of Related Arts

In every person's daily life the restroom or bathroom is undoubtedly one of the most frequently visited places, due to the fact that everyone must unavoidably use the restroom several times in a day. Although the restroom is an important place in a person's daily life, it is scarcely emphasized. In addition, since the restroom involves the privacy of an individual, no one speaks of restrooms in social situations. As a result, the advancement of restrooms has not kept up with other advancements in civilization, even being reduced to a sub-culture.

In the evolving history of the restroom, certainly the present toilet is the most advanced one. The toilet can collect a man's excrement and discharge it into the outdoor disposing pool so that the indoor cleanness can be maintained and meet the criteria of improving a person's quality of life. Except for cosmetic changes, however, there has been little improvement in the function of a toilet. The most disliked aspect of today's toilet is that the unpleasant odor when using the toilet cannot be expelled from the toilet. Since the restroom is a small closed space associated with an individual's privacy, air therein cannot be well circulated to overcome the problem of a stagnant, unpleasant smell.

The conventional way to reduce the pollution of unpleasant smell, or odor, is for the restroom to have fans provided on the roof to discharge the odor to the outdoors. Unfortunately, its deodorizing effect is limited. Further, since the odor discharged will invariably disturb the environment of the neighborhood, the use of fans is not a perfect method. Recently, the most popular method for deodorizing is to suppress the odor by aid of an air freshener or a deodorizer. However, since so much odor is associated with man's excrement, it cannot be suppressed so easily. Moreover, if the smell and concentration of the aroma is not controlled properly, there may be an adverse interaction contributing to the generation of unpleasant smell.

ROC Application No. 87218003 discloses a deodorizing device for a toilet, which comprises a base plate provided immediately underneath the original seat pad. Such base plate has a shape corresponding to the seat pad and has one or more air intake holes provided around its inner periphery facing the toilet bowl and the seat pad. A venting pipe mounts on the base plate at the pivot connecting the seat pad and the toilet cover. A fan is provided at the other end of the venting pipe. Such fan can be fixed on the toilet cover or other positions of the toilet. The fan further provides an air-exhaust pipe. When the toilet is used, the fan draws odor generated from the excrement of the user through the air intake holes into the channel. The odor then passes to the fan via the venting pipe and is discharged outside through the air-exhaust pipe connected with the fan so that the odor in the toilet can be expelled completely.

However, according to that ROC Application, for the odor to be drawn by the fan, an air exhaust pipe must be provided to conduct the odor to the outside or to another passage such as the drain. This might occupy additional space in the bathroom. Moreover, odor drawn into the pipe and delivered straight to the outdoors would invariably spread outside, which not only is not hygienic, but also might cause complaints by neighbors. Furthermore, since the deodorizing device for the toilet disclosed in the ROC Application requires changes to the design of the original toilet, it is not economically worthwhile for the toilet structure commonly used in today's houses. In addition, the engineering involved in a changed toilet is not simple and might not fit in the structure of the traditional original floor plan because of an improper fit in construction, which could cause serious problems such as water leakage, etc.

Accordingly, the prior art for deodorizing a toilet still has many disadvantages and is not a perfect design yet, allowing for much room for improvement.

SUMMARY OF THE PRESENT INVENTION

One of the objects of the invention is therefore to provide a deodorizing seat pad for a toilet bowl, wherein odor generated in the toilet can be securely adsorbed in smooth hollow channels provided therein, and, after being deodorized, the resulting gas can be deodorized completely, and can then be discharged to the outside without causing secondary pollution.

Another object of the invention is to provide a deodorizing seat pad for a toilet bowl, which comprises an ozone-generating device to generate ozone for deodorizing odor drawn into the hollow channel under the seat pad and an active carbon container, provided at the air outlet of the ozone-generating device, for adsorbing residual odor to assure the cleanness of the gas discharged.

Still another object of the invention is to provide a deodorizing seat pad for a toilet bowl that can be installed readily on various existing types of toilet bowls without necessity to change the entire toilet bowl making the deodorizing seat pad low-cost to produce, convenient for fitting on the toilet bowl, and helpful for improving the quality of life for human beings.

BRIEF DESCRIPTION OF THE DRAWINGS

The drawings disclose an illustrative embodiment of the present invention that serves to exemplify the various advantages and objects hereof, and are as follows.

Representative symbols of main parts:

| | | | |
|---|---|---|---|
| 1 | toilet bowl | 2 | ozone-generating device |
| 21 | air intakes | 22 | air outlet |
| 3 | seat pad | 31 | pivot |
| 32 | air scoop | 4 | base plate |
| 41 | air holes | 5 | hollow channel |
| 6 | fan | 7 | active carbon container |
| 8 | toilet cover | | |

DETAILED DESCRIPTION OF THE PREFERRED EMBODIMENT

Figure 1:
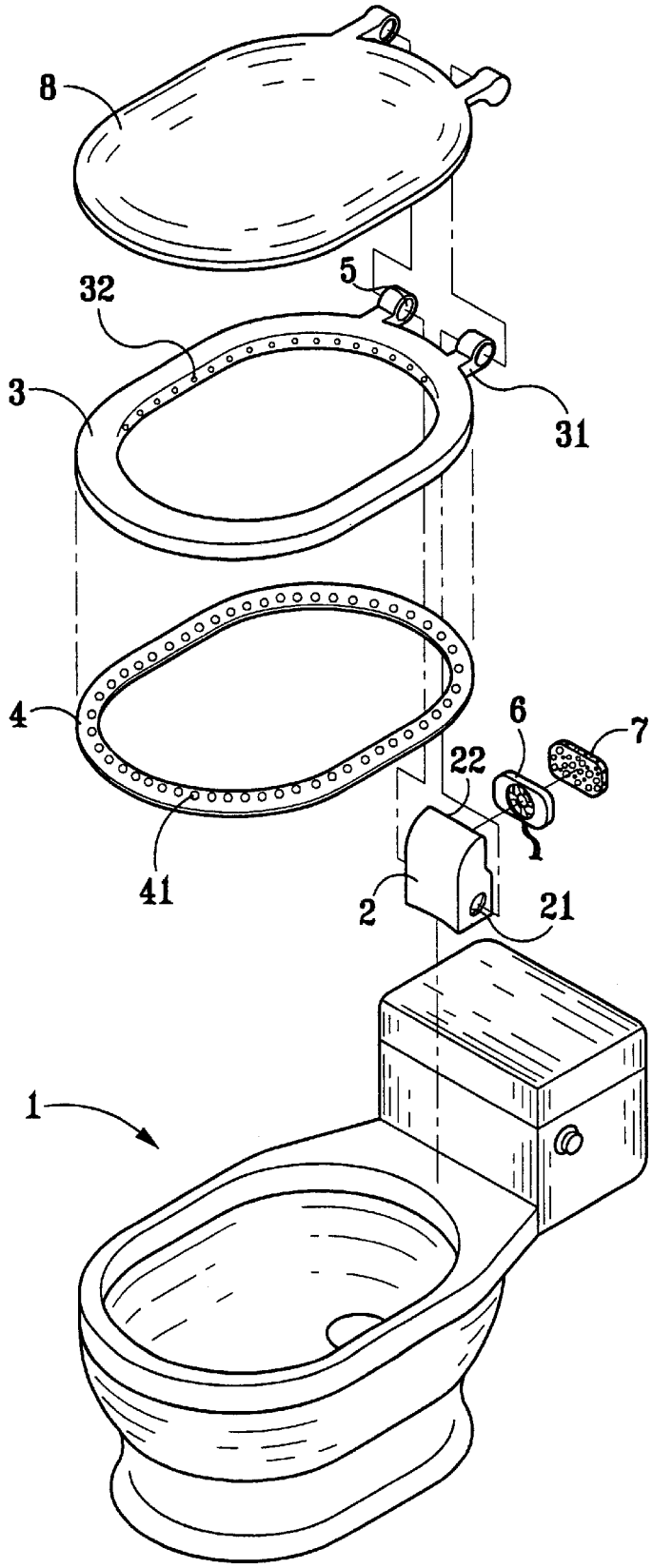
FIG. 1 is an exploded perspective view of a deodorizing seat pad according to the invention.
Figure 2:
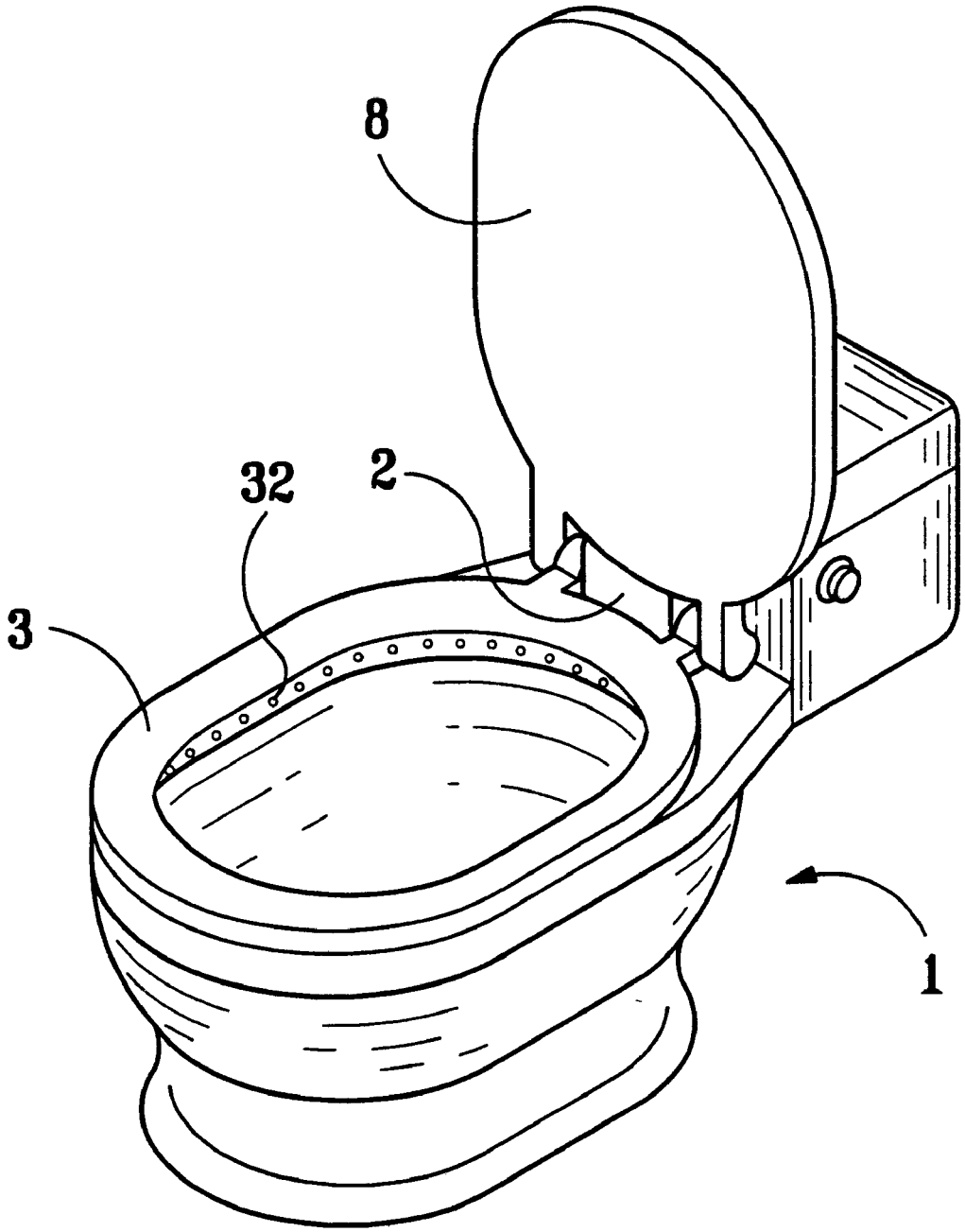
FIG. 2 is a perspective assembly view of the deodorizing seat pad according to the invention.
Figure 3:
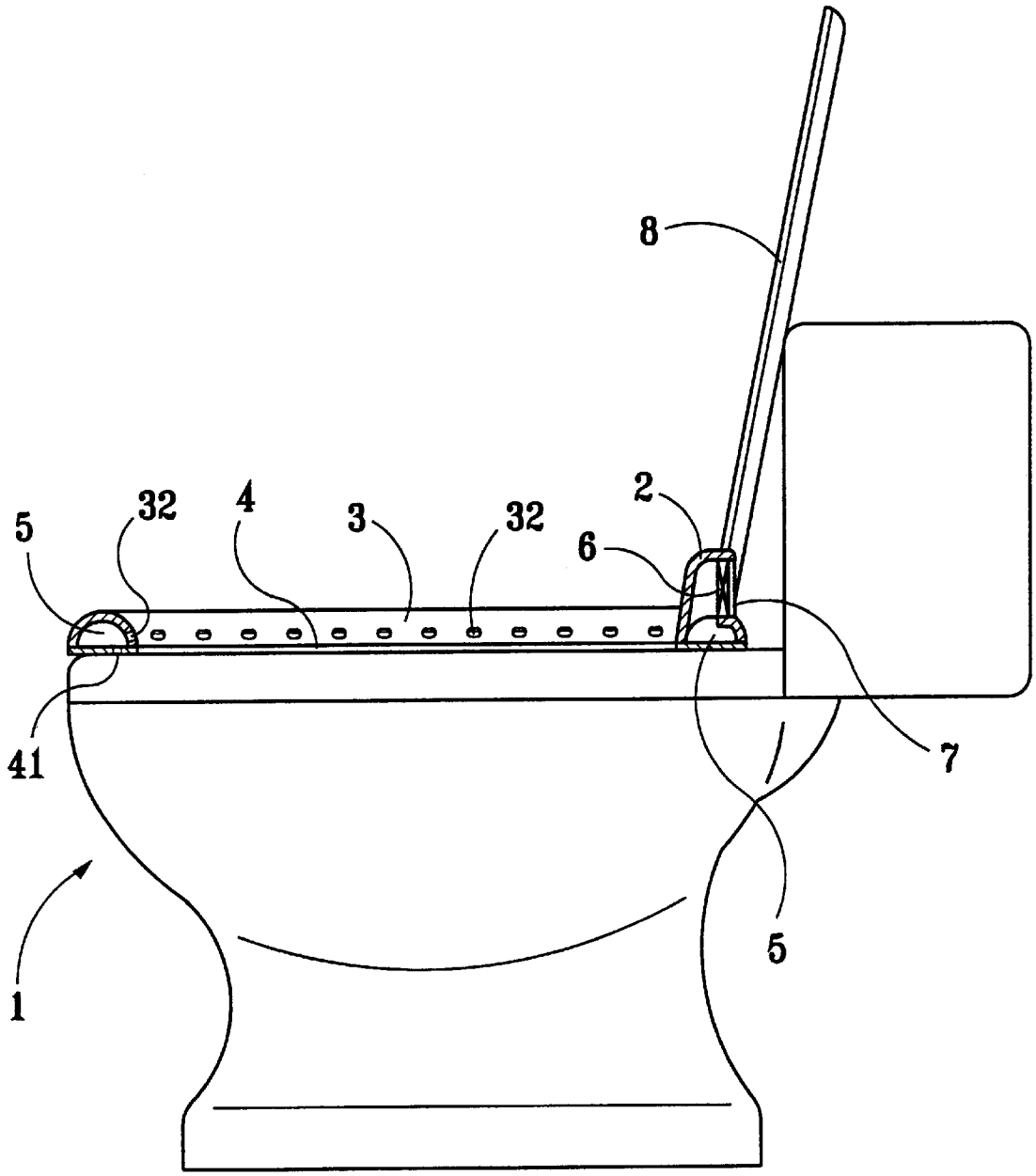
FIG. 3 is a detailed structural view of the deodorizing seat pad according to the invention.

Referring to FIG. 1 of the drawings, a deodorizing seat pad for a toilet bowl provided according to the present invention is a device to be installed on a toilet bowl 1 and to be used for eliminating the unpleasant odor from excrement. A deodorizing seat pad of the present invention comprises an ozone-generating device 2, a seat pad 3, a base plate 4, a fan 6, and an active carbon container 7.

The ozone-generating device 2 provided on the rear end of the toilet bowl 1, for generating ozone, contains air intakes 21 provided on both sides of said ozone-generating device 2 for drawing in odor from toilet bowl 1 and an air outlet 22 provided on the rear end of the ozone-generating device 2 for discharging ozone-treated gas.

The seat pad 3 further comprises a pivot 31 provided on a rear end thereof. The pivot 31 is mounted on air intakes 21 at both sides of said ozone-generating device 2 for introducing odor drawn from the toilet bowl. One or more air scoops 32 are provided along the inner periphery of the seat pad 3. The air scoops 32 are used for drawing in odor from the toilet bowl 1 into the ozone-generating device 2.

The base plate 4 is attached tightly at the bottom of said seat pad 3 such that a hollow channel 5 is formed between the base plate 4 and the seat pad 3 wherein the hollow channel 5 is guided through the pivot 31 of the seat pad 3 into the air intake 21 of the ozone-generating device 2. A plurality of air holes 41 are further provided on an inner periphery of the base plate 4 facing the toilet bowl 1 for enhancing the function of drawing the odor into the hollow channel 5 to be eventually discharged.

The fan 6 is installed at one end of the air outlet 22 of the ozone-generating device 2 for drawing in odor from the toilet bowl 1 through the air scoops 32 and air holes 41 at the toilet seat pad 3 and the base plate 4, respectively, into the ozone-generating device 2 where the odor is treated with ozone generated therein and then is discharged by the fan 6 to the outside atmosphere in order to assure the hygiene of the environment. The fan 6 is connected to a power supply (not shown) for controlling the operation of the fan 6.

The active carbon container 7 is used for containing active carbon and mounted at the end of the fan 6 not contacting with the ozone-generating device 2. By means of the active carbon, the active carbon container 7 is used for filtering further the odor discharged by the fan 6 in order to assure the clean quality of gas discharged. The active carbon in the active carbon container 7 provides a long-term effect for a definitive period of time.

Through a combination of the above-said components of the deodorizing seat pad according to the present invention, when in use, the fan 6 is started first to generate a function of drawing air from the toilet bowl 1. At this time, the fan 6 draws odor generated in the toilet bowl 1 through the air scoops 32 and air holes 41 provided on the seat pad 3 and the base plate 4, respectively, into the hollow channel 5. Then, odor in the hollow channel 5 can be drawn further through the air intakes 21 into the ozone-generating device 2 where odor can be treated with ozone to remove the stench component in the odor. Afterward, the treated odor is drawn further to pass through the active carbon container 7 to remove residual stench components by means of the adsorption by the active carbon. As a result, the odor can be discharged directly to the outside atmosphere without causing pollution or smell to the environment.

The toilet deodorizing process described above can be carried out during use of the toilet bowl 1 in order to keep the environment clean and such that the user can be in a pleasant mood. The process can also be carried out when a person is not using the toilet bowl 1, and thus the deodorizing process can be performed at any time. In this case, the toilet cover 8 provided on the toilet bowl 1 and seat pad 3 can be in the position of covering the toilet bowl 1 and seat pad 3 to assure that odor in the toilet bowl 1 cannot escape outwardly. The ozone-generating device 2 is designed and made by one skilled in the art of manufacturing thereof to match with the embodiment of the invention such that its shape and size can be varied in accordance with any size requirement for any toilet bowl 1.

Accordingly, the deodorizing seat pad for a toilet bowl 1 according to the present invention exhibits the following advantages over that of the recited ROC Application and other conventional techniques because:

1. The deodorizing seat pad can draw completely the odor generated in the toilet bowl and then subject the odor to a process involving ozone treatment and active carbon adsorption such that gas discharged is thoroughly deodorized and can be discharged directly to the outside without causing pollution of the environment.

2. The deodorizing seat pad can be installed readily onto the various existing types of toilet bowls without the necessity of changing the whole toilet bowl. The installation can be done conveniently and at a low cost. Furthermore, the maintenance thereof and the replacement of the active carbon can be easily performed, which gives the deodorizing seat pad of the present invention high potential for industrial development.

3. The deodorizing seat pad can be fitted easily at a low cost, adding to its popularity. Furthermore, it has a good deodorizing effect that is helpful to improve hygiene to promote a high quality of life desired by the modern individual.

Many changes and modifications in the above-described embodiment of the invention can, of course be carried out without departing from the scope thereof. Accordingly, to promote the progress in science and the useful arts, the invention is disclosed and is intended to be limited only by the scope of the appended claims.

What is claimed is:

1. A deodorizing seat pad device, comprising:

an ozone-generating device, which is adapted to be supported on a rear portion of a toilet bowl, having air intakes provided on both sides thereof and an air outlet provided on a rear end thereof;

a seat pad comprising a pivot provided on a rear end thereof and having one or more air scoops provided along an inner periphery thereof, wherein said pivot is mounted on said air intakes at said both sides of said ozone-generating device;

a base plate which is attached tightly at a bottom of said seat pad matching with a shape of said toilet bowl, wherein a hollow channel is formed between said base plate and said seat pad and a plurality of air holes are provided on an inner periphery of said base plate, wherein said hollow channel extends through said pivot of said seat pad into said air intakes of said ozone-generating device;

a fan which is installed at said air outlet of said ozone-generating device; and an active carbon container mounted at an end of said fan without contacting with said ozone-generating device;

wherein when said deodorizing seat pad is in use, air is drawn by said fan and odor generated in said toilet bowl is drawn through said air scoops provided on said seat pad and said air holes provided on said base plate into said hollow channel, and is passed further through said air intakes into said ozone-generating device where said odor is subjected to deodorizing, after which said treated odor is drawn through said air outlet through said fan and said active carbon container and discharged to the outside.

* * * * *